United States Patent [19]

Degen

[11] 4,397,727

[45] Aug. 9, 1983

[54] DEVICE FOR ELECTRODEPOSITING A SINGLE-SIDED METAL COATING ONTO A METAL STRIP, ESPECIALLY ONTO STEEL STRIP

[75] Inventor: Kurt Degen, Mending, Fed. Rep. of Germany

[73] Assignee: Rasselstein AG, Neuwied, Fed. Rep. of Germany

[21] Appl. No.: 356,995

[22] Filed: Mar. 11, 1982

[30] Foreign Application Priority Data

Mar. 17, 1981 [DE] Fed. Rep. of Germany ..... 3110225

[51] Int. Cl.[3] ..... C25D 17/00

[52] U.S. Cl. ..... 204/206

[58] Field of Search ..... 204/206, 28, 275;

[56] References Cited

U.S. PATENT DOCUMENTS 3,692,640 9/1972 Hamabe ..... 204/28

4,174,261 11/1979 Pellegrino ..... 204/273

4,310,403 1/1982 Nitto ..... 204/206

FOREIGN PATENT DOCUMENTS 46-23127 7/1971 Japan ..... 204/206

*Primary Examiner*—T. M Tufariello

*Attorney, Agent, or Firm*—Flynn, Thiel, Boutell & Tanis

[57] ABSTRACT

A device for galvanically depositing a metal coating on a side of a metal strip includes an anode housing which is connected to a power supply and includes one or more planar, vertical electroplating plates. The metal strip is also connected to the power supply and serves as a cathode, and is supported for vertical movement past the electroplating plate a short distance therefrom and parallel thereto. The electroplating plate includes a generally vertical outlet slot which permits electrolyte to flow out of the anode housing to the region between the electroplating plate and metal strip, and a pump returns the electrolyte to the anode housing. In a preferred embodiment, the outlet slot tapers downwardly and is inclined at a small angle to a vertical reference.

10 Claims, 7 Drawing Figures

DEVICE FOR ELECTRODEPOSITING A SINGLE-SIDED METAL COATING ONTO A METAL STRIP, ESPECIALLY ONTO STEEL STRIP

FIELD OF THE INVENTION

The invention relates to a device for electrodepositing a single-sided metal coating onto a metal strip, especially onto a steel strip, this device having an anode housing which is connected to a current supply and which possesses one or more electroplating plates, arranged essentially vertically, past which the metal strip, which is connected as the cathode, is moved vertically and parallel thereto, the electroplating plate possessing one or more outlet openings, from which the electrolyte emerges into the gap between the electroplating plate and the metal strip, the device also possessing a pump which pumps the electrolyte back into the anode housing.

BACKGROUND OF THE INVENTION

In a known device of this type (German Offenlegungsschrift No. 3,011,005), the anode housing is arranged essentially horizontally and possesses the electroplating plate on its underside, this plate being provided with a plurality of holes. A major disadvantage of this arrangement is that it requires a comparatively large amount of space in the horizontal direction, and this is a particularly important factor, because several anode housings of this type usually have to be connected in series. Moreover, the case of a horizontal arrangement, it is comparatively difficult, due to the possibility of the metal strip sagging and to non-uniform strip-tensions, to maintain a constant spacing between the electroplating plate and the metal strip. Non-uniform spacings lead, however, to irregular deposits of the coating metal.

It has also been proposed, as initially mentioned, to arrange the anode housing vertically, thus enabling the strip to be moved past the electroplating plate which stands vertically. Since, with this arrangement, the electrolyte issuing from the holes in the electroplating plate quickly flows away downwards, due to the gravitational forces, it remains only momentarily in contact with the surface of the metal strip. Even by this means, it is impossible to produce a metal coating having a uniform thickness and, moreover, the device does not function economically.

The object underlying the invention is to produce a device for electrodepositing a single-sided metal coating onto a metal strip, especially onto a steel strip, of the type initially mentioned, in which device the vertical gap between the electroplating plate and the metal strip which is moved vertically past this plate is completely and uniformly filled, the device thereby making it possible to deposit metal coatings having a constant thickness and, in addition, operating economically.

SUMMARY OF THE INVENTION

This object is achieved, according to the invention, in that the electroplating plate is provided with at least one outlet slot for the electrolyte, this slot being essentially vertical and extending in the direction in which the strip runs.

A comparatively large amount of electrolyte can emerge, at the same time, through this vertical outlet slot. Since it is possible to keep the gap between the electroplating plate and the strip very small, the electrolyte flows, between the electroplating plate and the metal strip, laterally towards the longitudinal edges of the strip. In doing so, it completely fills the gap between the electroplating plate and the metal strip, since sufficient electrolyte always flows in afterwards through the outlet slot. By this means, the deposition, onto the metal strip, of a uniformly thick metal coating is guaranteed, and the device also operates very economically. In addition, the electrolyte, issuing at a high rate from the outlet slot, forms a pressure-cushion between the electroplating plate and the metal strip, this cushion always reliably holding the metal strip clear of the electroplating plate. In consequence of this, it is possible to work with an extremely small gap width and the deposition voltage can consequently be kept low, this likewise contributing to the increase in economy. Moreover, the device, according to the invention, can be used for metal strips of different widths, without additional auxiliary equipment.

Advantageous embodiments of the invention are characterised in the sub-claims.

BRIEF DESCRIPTION OF THE DRAWINGS

In the text below, the invention is explained by reference to several illustrative embodiments which are represented in the drawing, in which.

DETAILED DESCRIPTION

Figure 1:
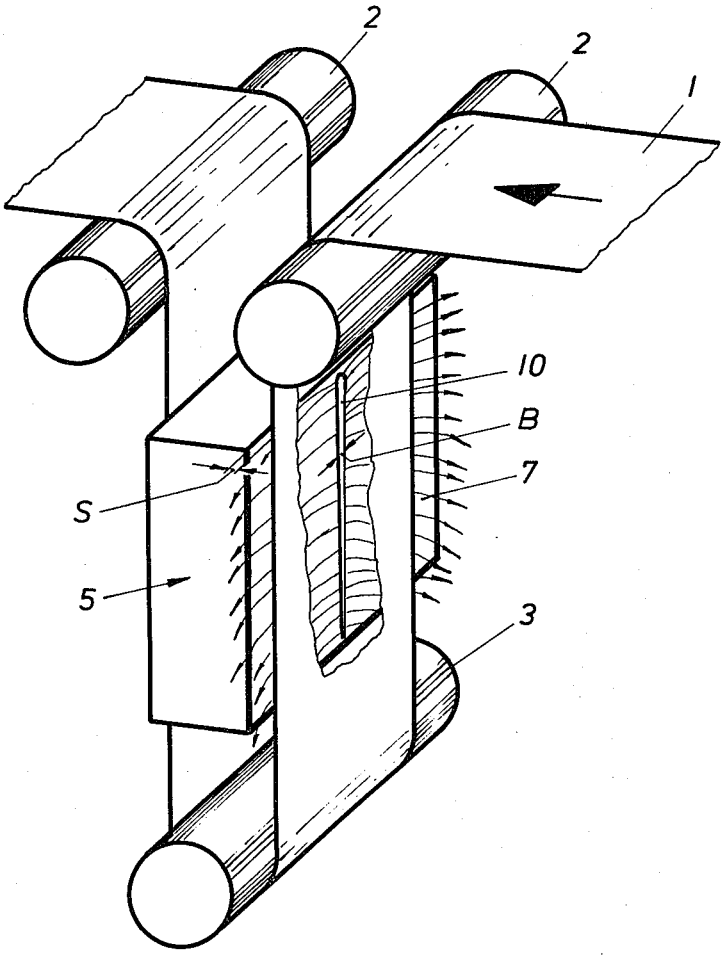
FIG. 1 shows a diagrammatical representation of the operating principle of the device according to the invention.
Figure 2:
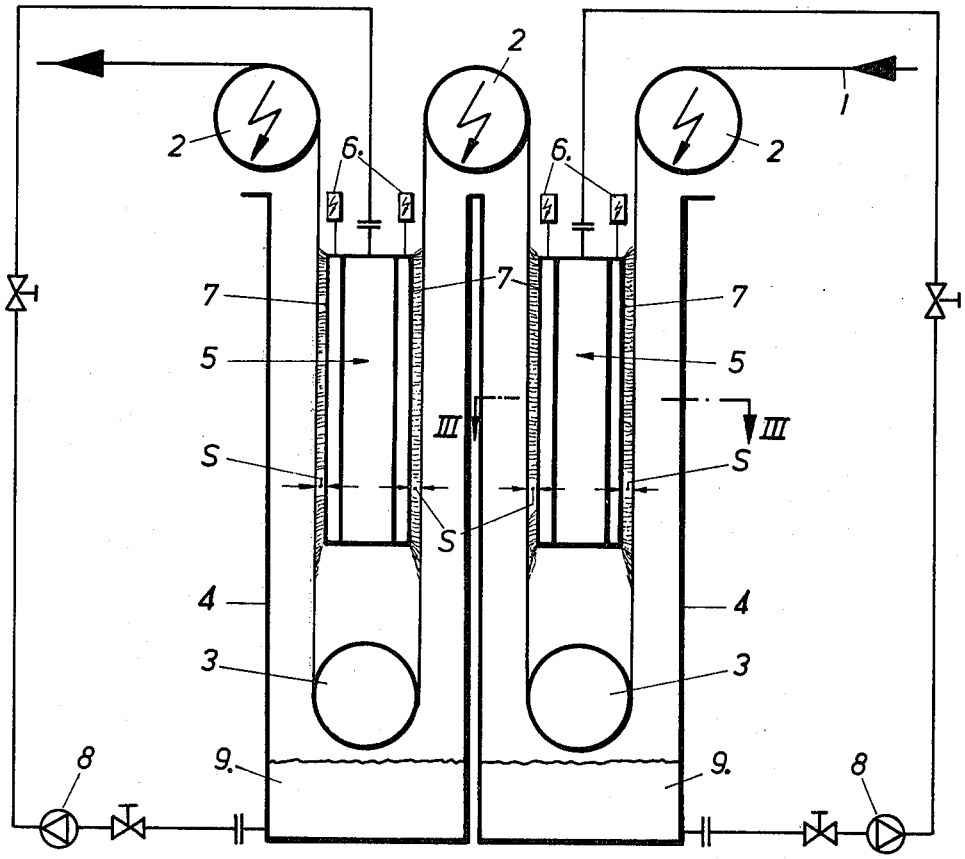
FIG. 2 shows a vertical longitudinal section of an electroplating unit employing the device according to the invention.
Figure 3:
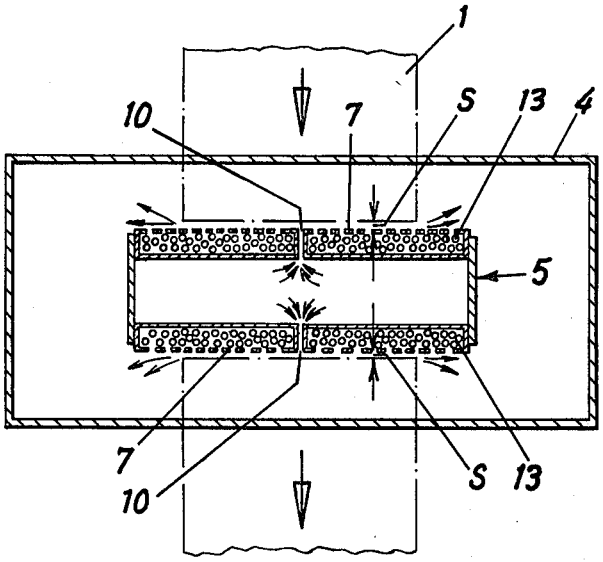
FIG. 3 shows a horizontal section according to the line III—III in FIG. 2.

Referring to FIGS. 1 and 2, the metal strip 1 is led vertically through the tanks 4 by means of the current-rollers 2 and the reversing rollers 3. The metal strip 1 is electrically energized as a cathode by means of the current-rollers 2. An anode housing 5 is located in each of the tanks 4 and is connected to a current supply 6. In the illustrative embodiment shown, each of the two anode housings 5 possesses, on each side, an electroplating plate 7, which is arranged vertically and past which the metal strip 1 is moved vertically, leaving a gap or space S. The electrolyte 9 is pumped into the anode housing 5 by means of a pump 8, emerges through a vertical outlet slot 10, which is provided in each electroplating plate 7, and enters the gap S which is present between the electroplating plate 7 and the metal strip 1. The outlet slot 10 extends in the direction in which the strip runs. As a rule, a single outlet slot 10 is sufficient, and is located in the middle of the electroplating plate 7.

Since the anode housing 5 and the electroplating plate 7 have a height of, for example, 1.2 m, the static pressure in the lower portion of the anode housing is greater than in the upper portion. For this reason, it is advantageous if the width B of the outlet slot 10 tapers towards its lower end. It is advantageous if the outlet slot 10 extends essentially over the entire height of the electroplating plate 7.

As already mentioned, the anode housing is provided, on each side, with an electroplating plate, and the metal strip 1 is, with the interposition of the reversing roller 3, moved past the anode housing 5 on both sides. By this means, deposition of coating metal is effected twice in the course of one passage through the device by the strip, and the device can be built in a particularly compact manner.

Figure 4:
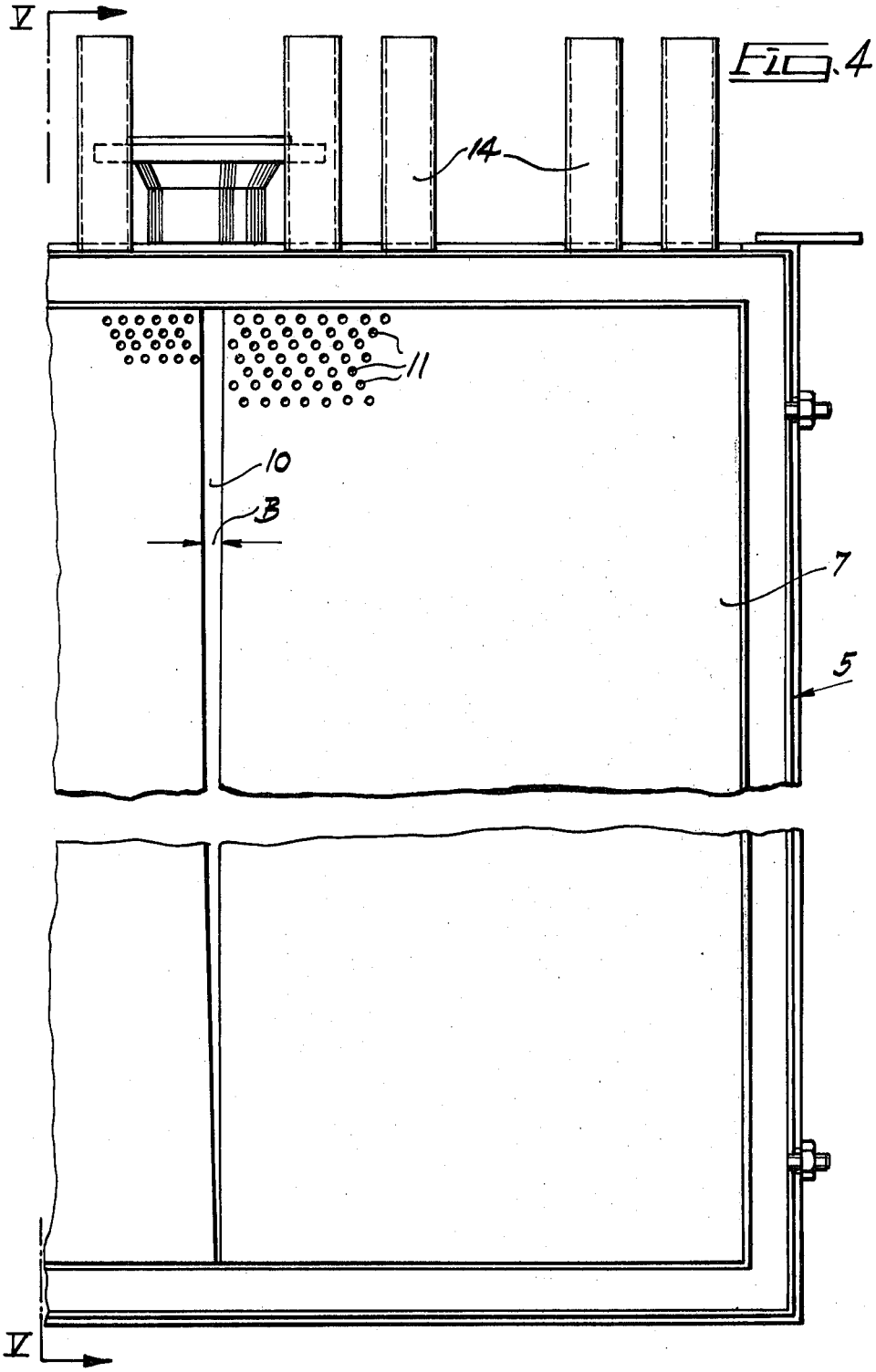
FIG. 4 shows a partial side view of the anode housing.
Figure 5:
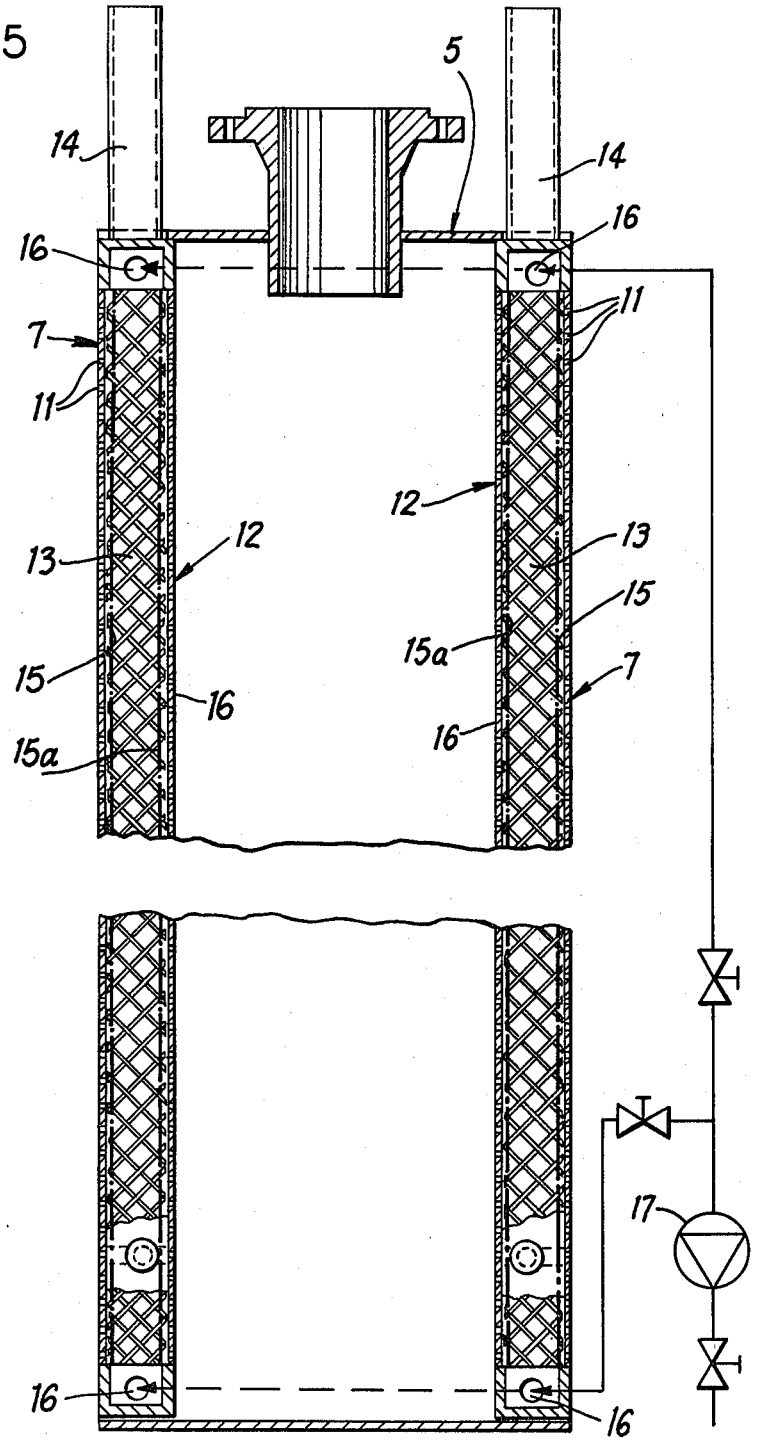
FIG. 5 shows a vertical cross-section according to the line V—V in FIG. 4.
Figure 6:
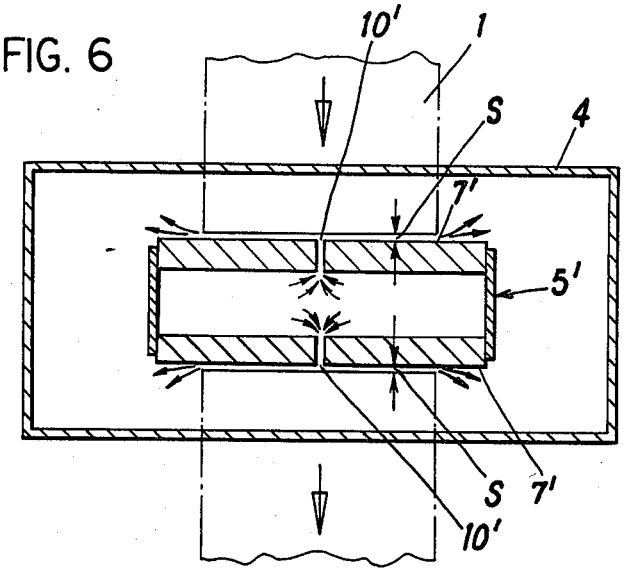
FIG. 6 shows a horizontal section through a second illustrative embodiment.

The device, according to the invention, can be designed either for soluble anodes, which maintain the metal content of the electrolyte by means of anodic dissolution, as shown, in particular, by FIGS. 4 and 5, or it can possess an insoluble anode, as shown in FIG. 6, in which case it is then necessary to supplement the concentration of metal in the electrolyte by means of regular additions.

The design according to FIGS. 4 and 5, with soluble anodes, is a very advantageous embodiment, especially in depositing zinc or a zinc-nickel alloy, because, in this case, the components of the anode housing can be made of titanium. In contrast to this, problems occur when insoluble anodes are used, with regard to the anode material and on account of the evolution of harmful gases.

In the illustrative embodiment represented in FIGS. 4 and 5, the electroplating plate 7 is provided with a plurality of holes 11, in addition to the outlet slot 10. In this case, it is possible, for example, to use a perforated plate as the electroplating plate, the holes in this plate having a diameter of 10 mm and a spacing of 14 mm. A basket 12 is provided on the inner surface of the electroplating plate 7, this basket serving to receive the comminuted coating metal 13. This coating metal can be used in the form of granules or spheres and can be replenished through several filling nozzles 14 which are provided in the region of the basket 12. In this illustrative embodiment, the electroplating plate 7 also forms, at the same time, the outer closing wall of the basket 12, it being possible for the inner closing wall of the basket to consist of a continuous metal sheet 16.

If required, it is possible to provide, in addition, a woven fabric 15, which is resistant to electrolyte, on the inner surface of the electroplating plate 7, this fabric being represented by dash-dotted lines in FIG. 5. In order to obtain as simple an arrangement as possible, a sack is expediently formed from a woven-plastic fabric, preferably made of polypropylene, one side 15 of this sack resting against the inner surface of the electroplating plate 7, and the other side 15*a* resting against the metal sheet 16 of the basket 12. The woven plastic fabric 15, 15*a* has a dual function. It is intended to hold back impurities which are present in the comminuted coating metal and which are released therefrom when the metal is dissolved, and it is further intended to prevent the pieces of metal, which become smaller as a result of gradual dissolution, from emerging through the holes 11. When a soluble coating metal 13 is used, the holes 11 are required merely to guarantee that current can pass from the coating metal 13 in the gap S. At the same time, the arrangement of the holes 11 must be chosen in a manner such that the holes laterally overlap each other in the direction in which the strip runs, in order to guarantee uniform deposition.

The mode of operation of the device which has been described is as follows:

Electrolyte is pumped into the anode housing 5 by means of the pump 8, and then issues from the outlet slots 10 in a wave-like manner. In the case of a metal strip 1 having a width of approximately 1.6 m, the electrolyte should emerge from each slot at a flow-rate of not less than 150 $m^3$ per hour. The electrolyte issuing from the outlet slot 10 completely fills the gap S between the electroplating plate 7 and the strip 1, and is diverted, by the strip 1, towards the longitudinal edges of the strip 1. The electrolyte then flows into the lower portion of the tank 4, and is once again pumped back into the anode housing 5 by the pump 8. The dimensions of the outlet slot 10, the delivery rate of the pump 8, and the gap S between the electroplating plate 7 and the metal strip 1, should be chosen such that the electrolyte essentially emerges only at the longitudinal edges of the metal strip 1. During the process of deposition, the coating metal, for example zinc or nickel, which is located in the basket 12 gradually dissolves. Since, during this process, the spacing between the coating metal 13, which functions as the anode, and the strip 1 does not, however, change, and since, furthermore, the pressure of the electrolyte, flowing out of the outlet slot 10, holds the metal strip 1 at a constant spacing with respect to the electroplating plate 7, a very uniform deposit of coating metal is produced on the metal strip 1. The coating metal which is gradually being consumed is replenished through the filling nozzles 14.

In the illustrative embodiment represented in FIG. 6, the electroplating plate 7' possesses only the central outlet slot 10'. In this case, the electroplating plate 7' is designed as an insoluble anode. The mode of operation of this device corresponds to the device described above, with the differences that the concentration of metal in the electrolyte must be supplemented by regular additions, and that the electrolysis current leaves via the surface of the electroplating plate 7'. This can be brought about, for example, by adding the appropriate metal salt to the electrolyte before the latter is pumped back again into the anode housing 5.

Figure 7:
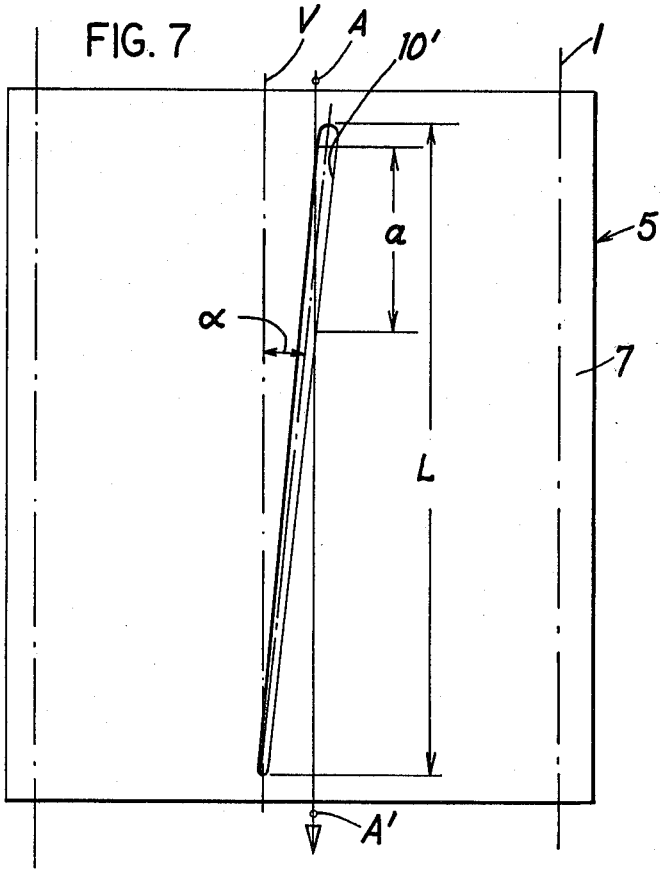
FIG. 7 shows a side view of a third illustrative embodiment.

In the third illustrative embodiment, represented in FIG. 7, the outlet slot 10'' is somewhat inclined with respect to the vertical reference V, and, in particular, in a manner such that the regions of the metal strip 1 which are moved past the outlet slot 10'' face the outlet slot 10'', in each case, only over a portion a of its entire length L. If, for example, the metal strip is moved past the anode housing 5, in the downward direction, its region A moves to the point A'. During the movement of the metal strip 1 past the slot 10'', the region A does not face the slot except over the distance a, while the region A faces the metallic portion of the electroplating plate 7 over the remaining portion of the entire length L of the slot. The outlet slot behaves in an electrolytically inactive manner. As a result of the inclined position of the outlet slot, a defined region of the metal strip is located in the inactive portion of the exit slot 10', only over a small portion a of the total length L of the slot, while the same region of the metal strip is moved past the electrolytically active electroplating plate 7, over a greater length. By this means, a smoothing-out of the deposition on the metal strip is achieved in the region of the outlet slot 10'.

With regard to the possibility of replenishing the comminuted coating metal from above through the filling nozzles 14, and also with regard to the uniform distribution of the electrolyte on either side of the outlet slot 10'', the slot should be inclined with respect to the vertical at an angle α of approximately 4° to 8°, preferably 5°.

If a soluble anode is used, in which case the comminuted coating metal 13 is arranged in a basket 12, it is essential, to ensure uniform metal deposition, that all interspaces within the comminuted coating metal 13 are filled with electrolyte. In order to achieve this, it is advantageous if the anode housing 7 possesses, as shown in FIG. 5, additional inflow opening 16 in the region of the basket 12, these openings being connected to an additional electrolyte pump 17. It is possible, by means of this electrolyte pump 17 and the inflow openings 16, to fill the basket with electrolyte, via a separate circulation system, either from above, and/or from below. By this means, it can be ensured that the interspaces within the comminuted coating metal are always filled with electrolyte.

The embodiments of the invention in which an exclusive property or privilege is claimed are defined as follows:

1. A device for galvanically depositing a metal coating on a side of a metal strip, including an anode housing which is connected to a power supply and includes at least one substantially vertical and flat electroplating plate, said metal strip being connected to said power supply, serving as a cathode, and being supported for substantially vertical movement past said electroplating plate parallel thereto and spaced slightly therefrom, said electroplating plate having at least one outlet slot, an electrolyte provided in said anode housing and flowing through said outlet slot into the space between said electroplating plate and said metal strip, and pump means for pumping said electrolyte back into said anode housing, the improvement comprising wherein said electroplating plate has a single said outlet slot which is provided in a center region thereof, extends substantially in the direction of movement of said metal strip, is inclined with respect to a vertical reference by an acute angle of approximately 4°–8°, and tapers in width toward the lower end thereof.

2. Device according to claim 1, wherein said outlet slot extends substantially the entire height of said electroplating plate.

3. Device according to claim 1, wherein said anode housing has a said electroplating plate on each side thereof, said metal strip, guided by a reversing roller rotatably supported adjacent said anode housing, moving past said electroplating plates on both sides of said anode housing.

4. Device according to claim 1, wherein said anode housing includes a basket which is provided adjacent an inner surface of said electroplating plate and is adapted to receive a comminuted coating metal which serves as the anode and is soluble in said electrolyte.

5. Device according to claim 4, including a woven fabric which is resistant to said electrolyte and is provided adjacent said inner surface of said electroplating plate.

6. Device according to claim 5, wherein said basket is lined with a sack made of said fabric, said fabric being a woven plastic fabric.

7. Device according to claim 4, wherein said anode housing includes, in the region of said basket, several filling nozzles through which said comminuted coating metal can be supplied to said basket.

8. Device according to claim 1, wherein said electroplating plate is an insoluble anode.

9. Device according to claim 1, wherein the delivery rate of said pump means is selected, with regard to the dimensions of said outlet slot and the distance between said electroplating plate and said metal strip, so that said electrolyte flowing through said outlet slot flows toward and emerges primarily at the lateral edges of said metal strip.

10. Device according to claim 4, wherein said anode housing has, in the region of said basket, additional inflow openings for permitting said electrolyte to flow into said anode housing, said inflow openings being in communication with an additional pump means which supplies electrolyte to said inflow openings.

* * * * *